US011308869B2

(12) United States Patent
Yamamoto et al.

(10) Patent No.: US 11,308,869 B2
(45) Date of Patent: Apr. 19, 2022

(54) IMAGE LIGHT GENERATION MODULE AND IMAGE DISPLAY DEVICE

(71) Applicant: SEIKO EPSON CORPORATION, Tokyo (JP)

(72) Inventors: Hidetoshi Yamamoto, Suwa (JP); Yuiga Hamade, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/031,857

(22) Filed: Sep. 24, 2020

(65) Prior Publication Data

US 2021/0097932 A1 Apr. 1, 2021

(30) Foreign Application Priority Data

Sep. 26, 2019 (JP) ..... JP2019-175888

(51) Int. Cl.
*G09G 3/3208* (2016.01)
*G09G 3/16* (2006.01)
*G09G 3/20* (2006.01)

(52) U.S. Cl.
CPC ..... *G09G 3/3208* (2013.01); *G09G 3/16* (2013.01); *G09G 3/2003* (2013.01)

(58) Field of Classification Search
CPC ..... G09F 7/02; G09G 2300/0426; G09G 2320/0242; G09G 2320/045; G09G 2340/0464; G09G 3/002; G09G 3/16; G09G 3/2003; G09G 3/3208; Y10S 261/53; G02F 1/134336; H01L 27/322; H01L 27/3218; H01L 25/048; H01L 27/323; H04N 9/3138; H04N 9/315; G02B 27/144; G02B 27/283
See application file for complete search history.

(56) References Cited

U.S. PATENT DOCUMENTS 6,259,423 B1 * 7/2001 Tokito ..... H01L 25/048 313/504
2003/0063262 A1 * 4/2003 Kim ..... G02B 27/283 353/31
2004/0021833 A1 * 2/2004 Koide ..... H04N 9/3138 353/31

(Continued)

FOREIGN PATENT DOCUMENTS

JP 2000066301 A * 3/2000 ..... H04N 9/3138
JP 2000275732 10/2000

*Primary Examiner* — Richard J Hong
(74) *Attorney, Agent, or Firm* — JCIPRNET

(57) ABSTRACT

An image light generation module according to the present disclosure includes a first panel configured to emit first image lighting a red wavelength region not having polarization characteristics, a second panel configured to emit second image light in a blue wavelength region not having polarization characteristics, a third panel configured to emit third image light in a green wavelength region not having polarization characteristics, and a color combining prism configured to emit combined light obtained by combining the first image light, the second image light, and the third image light. The first panel, the second panel, and the third panel each include a pixel structure in which a plurality of pixels are disposed, and aperture ratios of the pixels of the first panel, the second panel, and the third panel differ from each other.

7 Claims, 8 Drawing Sheets

(56) References Cited

U.S. PATENT DOCUMENTS

| | | | | |
|---|---|---|---|---|
| 2005/0237495 | A1* | 10/2005 | Peterson | H04N 9/315 348/E9.027 |
| 2010/0117528 | A1* | 5/2010 | Fukuda | H01L 27/322 313/505 |
| 2011/0149547 | A1* | 6/2011 | Bruzzone | G02B 27/144 362/19 |
| 2014/0063422 | A1* | 3/2014 | Chu | G02F 1/134336 349/110 |
| 2016/0240594 | A1* | 8/2016 | Zhu | H01L 27/3218 |
| 2017/0317145 | A1* | 11/2017 | Hong | H01L 27/323 |

* cited by examiner

| | FIRST PANEL 10 | SECOND PANEL 20 | THIRD PANEL 30 |
|---|---|---|---|
| OPENING RATIO (%) | 60. 0 | | |
| LIFETIME [LT50] (h) | 8000 | 6500 | 5000 |
| WHITE POINT (x, y) | (0. 31, 0. 31) | | |
| ⊿u' v' [LT50] | 0. 0335 | | |
FIG. 4
| | FIRST PANEL 10 | SECOND PANEL 20 | THIRD PANEL 30 |
|---|---|---|---|
| OPENING RATIO (%) | 45. 5 | 51. 4 | 60. 0 |
| LIFETIME [LT50] (h) | 4998 | 4995 | 5000 |
| WHITE POINT (x, y) | (0. 31, 0. 31) | | |
| ⊿u' v' [LT50] | LESS THAN 0.001 | | |
FIG. 5
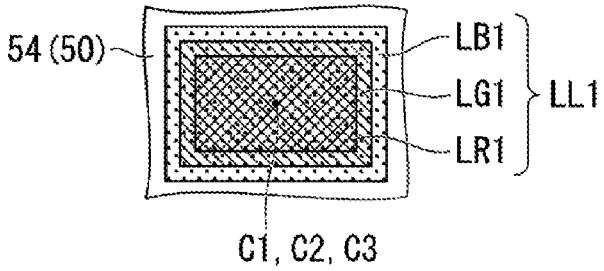
FIG. 6
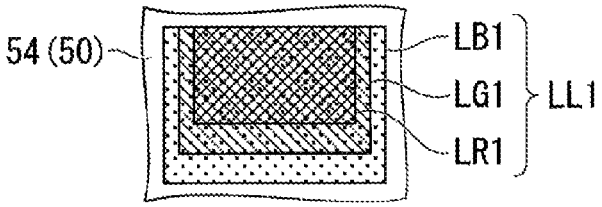
FIG. 7A

IMAGE LIGHT GENERATION MODULE AND IMAGE DISPLAY DEVICE

The present application is based on, and claims priority from JP Application Serial Number 2019-175888, filed Sep. 26, 2019, the disclosure of which is hereby incorporated by reference herein in its entirety.

BACKGROUND

1. Technical Field

The present disclosure relates to an image light generation module and an image display device.

2. Related Art

JP-A-2000-275732 discloses an image light generation module including a first display unit configured to emit blue light, a second display unit configured to emit green light, a third display unit configured to emit red light, and a cross dichroic prism configured to combine the light emitted from the display units. In this image light generation module, each of the display units includes a liquid crystal panel and an organic electroluminescent (EL) panel as a backlight for each color light.

In recent years, configuring the display units described above using only organic EL panels has also been considered. That is, configuring an image light generation module that emits combined light of a white color using three organic EL panels that emit each color light, and a dichroic prism, has been considered.

However, a lifetime characteristic of an organic EL element is generally highly dependent on the light-emitting material and the element configuration and thus, when organic EL panels of three colors are used, presumably the lifetime characteristic differs for each panel. When a lifetime difference occurs for each panel in this way, a difference arises in a deterioration rate for each color. As a result, there is a problem in that a color shift associated with deterioration over time occurs in the white light emitted from the image light generation module, and the quality of the display image declines.

SUMMARY

To solve the problems described above, an image light generation module according to a first aspect of the present disclosure includes a first panel configured to emit first image light in a red wavelength region not having polarization characteristics, a second panel configured to emit second image light in a green wavelength region not having polarization characteristics, a third panel configured to emit third image light in a blue wavelength region not having polarization characteristics, and a color combining prism configured to emit combined light obtained by combining the first image light, the second image light, and the third image light. The first panel, the second panel, and the third panel each include a display region provided with a plurality of pixels and pixel aperture ratios of the first panel, the second panel, and the third panel differ from each other.

In the image light generation module described above, the color combining prism may include an emitting surface configured to emit the combined light and, in plan view of the emitting surface, at least a portion of each of first pixel light emitted from a first pixel of the first panel, second pixel light emitted from a second pixel of the second panel, and third pixel light emitted from a third pixel of the third panel may overlap.

In the image light generation module, the color combining prism may include an emitting surface configured to emit the combined light and, in plan view of the emitting surface, a first central axis passing through a center of a first pixel of a first pixel light emitted from the first pixel, the first pixel being of the first panel, a second central axis passing through a center of a second pixel of a second pixel light emitted from the second pixel, the second pixel being of the second panel, and a third central axis passing through a center of a third pixel of a third pixel light emitted from the third pixel, the third pixel being of the third panel may coincide with each other.

In the image light generation module, the first panel, the second panel, and the third panel may each have the same pixel pitch.

In the image light generation module, the first panel, the second panel, and the third panel may be configured as organic EL panels.

An image display device according to a second aspect of the present disclosure includes the image light generation module according to the first aspect described above.

BRIEF DESCRIPTION OF THE DRAWINGS

FIG. 4 is a table showing characteristics related to an image light generation module of a comparative example.

FIG. 5 is a table showing characteristics related to the image light generation module of this exemplary embodiment.

FIG. 6 is a drawing illustrating an emitting surface of a dichroic prism in plan view.

FIG. 7A is a diagram illustrating a modified example of a way of overlapping pixel light.

DESCRIPTION OF EXEMPLARY EMBODIMENTS

First Exemplary Embodiment

An exemplary embodiment of the present disclosure will be described below with reference to the accompanying drawings.

Figure 1:
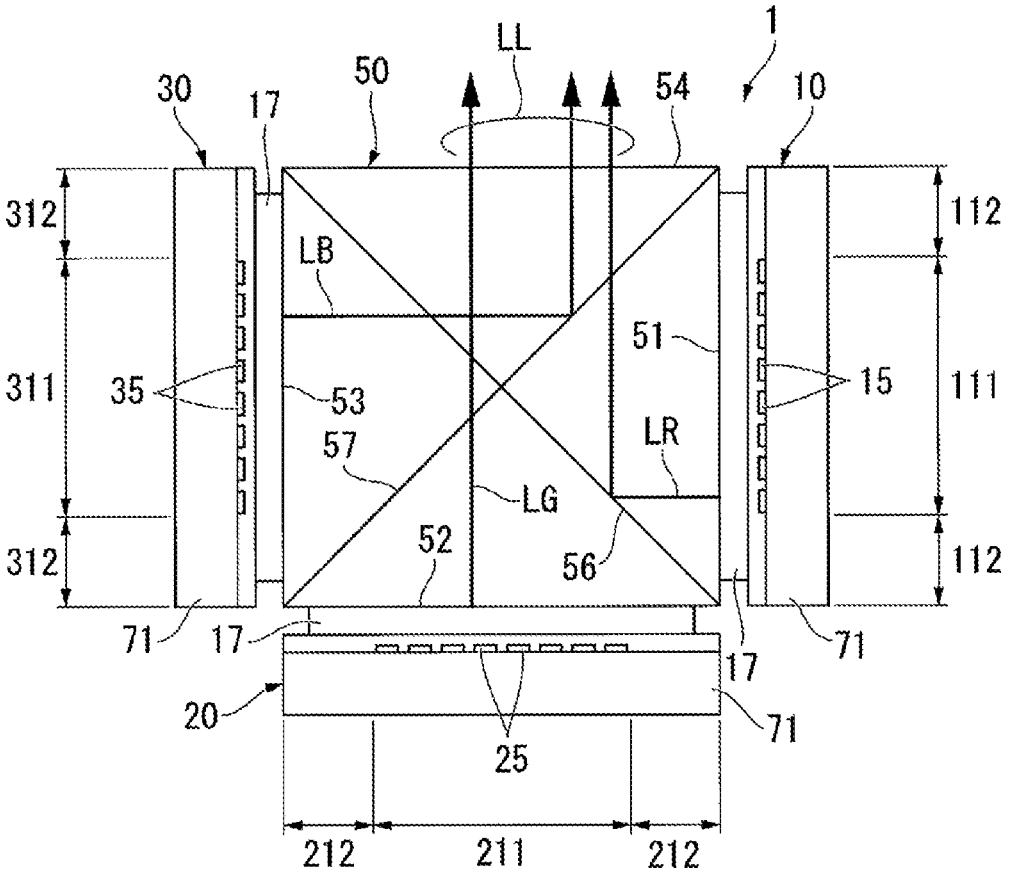
FIG. 1 is a schematic configuration view of an image light generation module according to a first exemplary embodiment.

FIG. 1 is a schematic configuration view of an image light generation module according to a first exemplary embodiment of the present disclosure.

Note that, in the drawings, the dimensions of some components may be scaled differently for ease of understanding of the components.

The image light generation module of the first exemplary embodiment is, for example, a module configured to combine a plurality of color light beams from a plurality of panels such as organic electroluminescent (EL) panels configured to emit image light not having polarization characteristics, and to emit the combined light.

As illustrated in FIG. 1, an image light generation device 1 includes a first panel 10, a second panel 20, a third panel 30, and a dichroic prism 50 (color combining prism). The first panel 10 includes a first display region 111 in which a plurality of pixels are provided in a matrix, and a non-display region 112. A first light-emitting element 15 is provided to each of the plurality of pixels. The second panel 20 includes a second display region 211 in which a plurality of pixels are provided in a matrix, and a non-display region 212. A second light-emitting element 25 is provided to each of the plurality of pixels. The third panel 30 includes a third display region 311 in which a plurality of pixels are provided in a matrix, and a non-display region 312. A third light-emitting element 35 is provided to each of the plurality of pixels.

In this exemplary embodiment, the plurality of first light-emitting elements 15 provided to the first display region 111 of the first panel 10 emit red light. Similarly, the plurality of second light-emitting elements 25 provided to the second display region 211 of the second panel 20 emit green light. Similarly, the plurality of third light-emitting elements 35 provided to the third display region 311 of the third panel 30 emit blue light. In this exemplary embodiment, the first light-emitting element 15, the second light-emitting element 25, and the third light-emitting element 35 are each composed of a top emission organic EL element. That is, the first panel 10, the second panel 20, and the third panel 30 are each formed of an organic EL panel.

Hereinafter, a configuration of the first panel 10, the second panel 20, and the third panel 30 will be described. The first panel 10, the second panel 20, and the third panel 30 differ from each other in material of a light-emitting layer and a transport layer formed of an organic EL material, but have the same basic configuration of the panel. Accordingly, the basic configuration of the panel will be described below using the first panel 10 as a representative.

Figure 2:
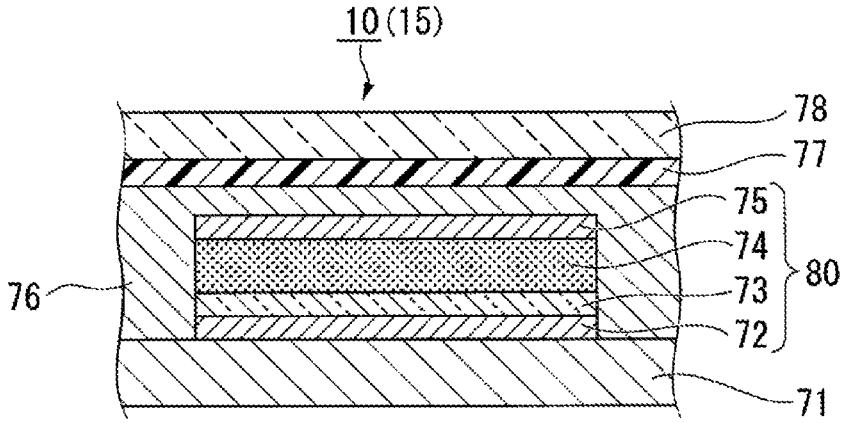
FIG. 2 is a cross-sectional view illustrating a configuration of a first light-emitting element.

FIG. 2 is a cross-sectional view illustrating a configuration of one first light-emitting element 15 of the first panel 10.

As illustrated in FIG. 2, the first panel 10 includes a reflective electrode 72, an anode 73, a light emission function layer 74, a cathode 75, a sealing film 76, a color filter 77, and a cover glass 78. Specifically, the reflective electrode 72, the anode 73, the light emission function layer 74, and the cathode 75 are provided on one surface of a substrate 71 in order from the substrate 71 side. The substrate 71 is formed of a semiconductor material such as silicon, for example. The reflective electrode 72 is formed of a light-reflective conductive material containing, for example, aluminum, silver, or the like. More specifically, the reflective electrode 72 may be formed of a single material such as aluminum, silver, or the like, or may be formed of a layered film of titanium (Ti)/aluminum copper alloy (AlCu), or the like, for example.

The anode 73 is formed of a conductive material having optical transparency, such as indium tin oxide (ITO), for example. Although not illustrated, the light emission function layer 74 is formed of a plurality of layers including a light-emitting layer including an organic EL material, a hole injecting layer, an electron injecting layer, and the like. The light-emitting layer is formed of a known organic EL material corresponding to each light emission color. Note that the light emitted by the light-emitting layer may be either fluorescent or phosphorescent.

The cathode 75 functions as a semi-transmissive reflective layer having properties (semi-transmissive reflective properties) that transmit some light and reflect the remaining light. For example, by forming a photoreflective conductive material, such as an alloy containing silver or magnesium, into a sufficiently thin film, it is possible to achieve the cathode 75 having the semi-transmissive reflective properties. The emitted light from the light emission function layer 74 has a component of a specific resonance wavelength being selectively amplified during reciprocation between the reflective electrode 72 and the cathode 75, is transmitted through the cathode 75, and is emitted to an observation side (opposite to the substrate 71). In other words, a plurality of layers from the reflective electrode 72 to the cathode 75 constitute an optical resonator 80.

The plurality of layers from the reflective electrode 72 to the cathode 75 are covered by the sealing film 76. The sealing film 76 is a film for preventing entry of air and moisture, and is formed of a single layer or a plurality of layers of an inorganic material or an organic material having optical transparency. The color filter 77 is provided to one surface of the sealing film 76.

In the first panel 10, the color filter 77 is formed of a light-absorbing filter layer that absorbs light in a wavelength region other than the red wavelength region and transmits light in the red wavelength region. Similarly, the color filter 77 of the second panel 20 is formed of a light-absorbing filter layer that absorbs light in a wavelength region other than the green wavelength region and transmits light in the green wavelength region. The color filter 77 of the third panel 30 is formed of a light-absorbing filter layer that absorbs light in a wavelength region other than the blue wavelength region and transmits light in the blue wavelength region.

In this exemplary embodiment, each of the first panel 10, the second panel 20, and the third panel 30 includes the optical resonator 80, and thus light corresponding to each color is emitted by resonance of light at a resonance wavelength. Furthermore, the color filter 77 is provided on a light emission side of the optical resonator 80, and thus color purity of the light emitted from each of the panels 10, 20, 30 is further enhanced. Note that the color filter 77 may be omitted depending on the wavelength region of light emitted from the light emission function layer 74.

The cover glass 78 for protecting each of the panels 10, 20, 30 is provided to one surface of the color filter 77.

As illustrated in FIG. 1, the first panel 10 emits first image light LR in the red wavelength region. Accordingly, the image light emitted from the first panel 10 is incident on the dichroic prism 50 as the first image light LR in the red wavelength region. The second panel 20 emits second image light LG in the green wavelength region. Accordingly, the image light emitted from the second panel 20 is incident on the dichroic prism 50 as the second image light LG in the green wavelength region. The third panel 30 emits third image light LB in the blue wavelength region. Accordingly, the image light emitted from the third panel 30 is incident on the dichroic prism 50 as the third image light LB in the blue wavelength region.

A peak wavelength in the red wavelength region is, for example, greater than or equal to 630 nm and less than or equal to 680 nm. A peak wavelength in the green wavelength region is, for example, greater than equal to 495 nm and less than or equal to 570 nm. A peak wavelength in the blue wavelength region is, for example, greater than or equal to 450 nm and less than or equal to 490 nm. Each of the first image light LR, the second image light LG, and the third image light LB is light not having polarization characteristics. In other words, each of the first image light LR, the second image light LG, and the third image light LB is unpolarized light not having a specific vibration direction. Note that unpolarized light, namely, light not having polarization characteristics is light that is not in a completely unpolarized state and includes a polarization component to some extent. For example, the light has a degree of polarization to the extent that does not actively affect an optical component such as a dichroic mirror, for example, in terms of optical performance, for example, a degree of polarization of less than or equal to 20%.

The dichroic prism 50 is composed of a light transmissive member having a quadrangular columnar shape. The dichroic prism 50 includes a first incident surface 51, a third incident surface 53 facing the first incident surface 51, a second incident surface 53 provided vertically in contact with the first incident surface 51 and the third incident surface 53, and an emitting surface 54 facing the second incident surface 52.

The dichroic prism 50 includes a first dichroic mirror 56 not having polarization separation characteristics, and a second dichroic mirror 57 not having polarization separation characteristics. The first dichroic mirror 56 and the second dichroic mirror 57 cross each other at an angle of 90°. The first dichroic mirror 56 has a characteristic so as to reflect the first image light LR and transmit the second image light LG and the third image light LB. The second dichroic mirror 57 has a characteristic so as to reflect the third image light LB and transmit the first image light LR and the second image light LG.

The first panel 10 is disposed facing the first incident surface 51. The second panel 20 is disposed facing the second incident surface 52. The third panel 30 is disposed facing the third incident surface 53. In this exemplary embodiment, the first panel 10 is fixed to the first incident surface 51 by an adhesive layer 17 having transmissivity. The second panel 20 is fixed to the second incident surface 52 by the adhesive layer 17 having transmissivity. The third panel 30 is fixed to the third incident surface 53 by the adhesive layer 17 having transmissivity.

The image light generation module 1 of this exemplary embodiment emits combined image light LL obtained by combining the first image light LR, the second image light LG, and the third image light LB from the emitting surface 54 of the dichroic prism 50.

Next, a pixel structure of each of the panels 10, 20, 30 will be described.

Figure 3:
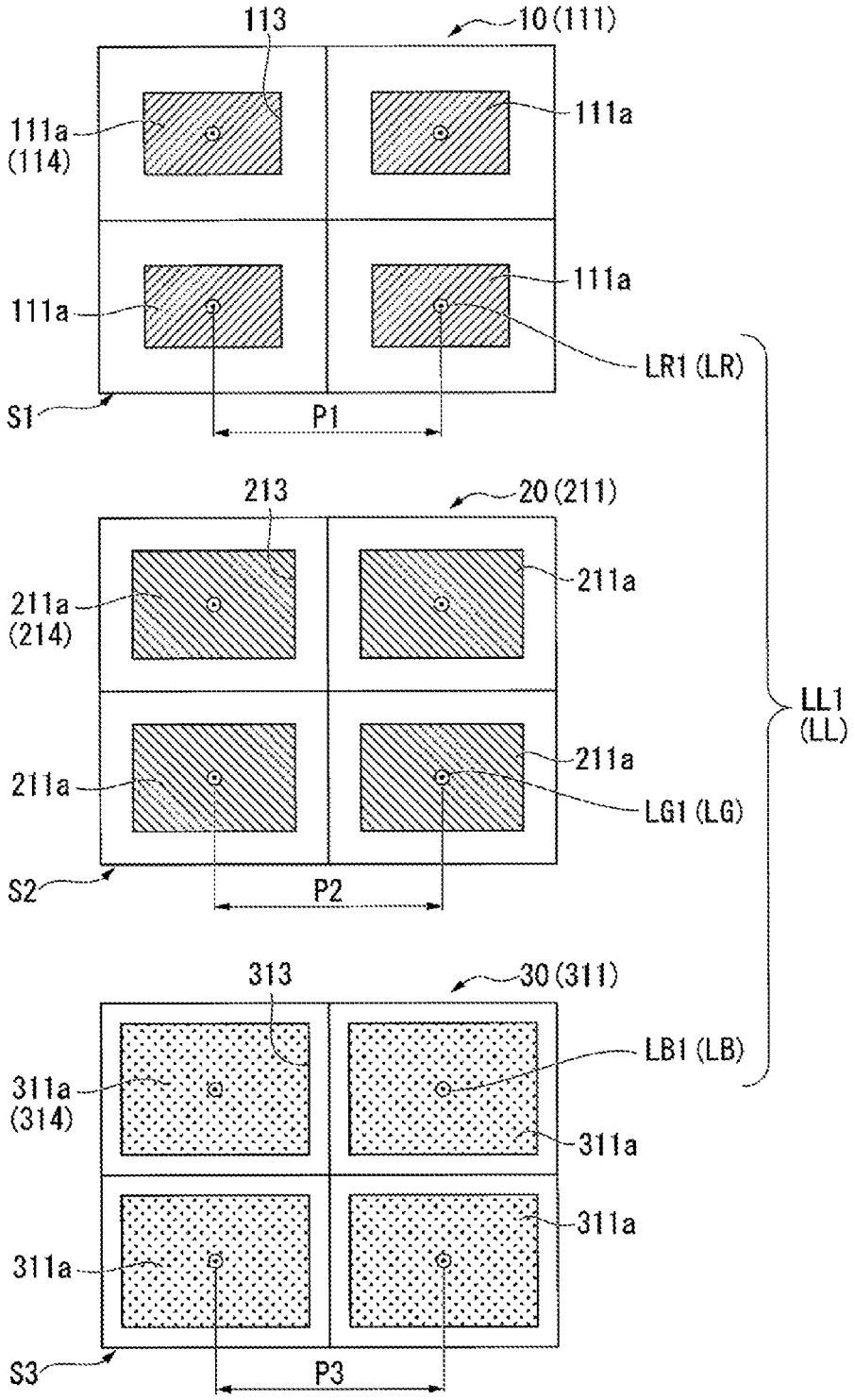
FIG. 3 is an enlarged view illustrating a comparison of main portions of a pixel structure of each panel.

FIG. 3 is an enlarged view illustrating main portions of the pixel structure of each of the panels 10, 20, 30 in a side-by-side manner. Note that, in FIG. 3, for ease of illustration, an enlarged view of a portion of the plurality of pixels constituting the pixel structure of each of the panels 10, 20, 30 is arranged in a vertical direction in a side-by-side manner.

As illustrated in FIG. 3, a plurality of pixels 111*a* having a rectangular shape are provided in a matrix in the first display region 111 of the first panel 10. The pixels 111*a* have the same size, and each is disposed at a predetermined pixel pitch P1. Here, in a case in which the color filter 77 (refer to FIG. 2) is formed in a divided manner for each of the pixels 111*a*, for example, the pixel pitch P1 is defined by a distance between a center of the color filter 77 provided to one pixel of two adjacent pixels 111*a* and a center of the color filter 77 provided to the other pixel.

Alternatively, in a case in which the color filter 77 is commonly provided to the plurality of pixels 111*a* and not formed in a divided manner, the pixel pitch P1 is defined by a distance between a center of the optical resonator 80 (refer to FIG. 2) provided to one pixel of two adjacent pixels 111*a* and a center of the optical resonator 80 provided to the other pixel.

Each of the pixels 111*a* emits first pixel light LR1 that constitutes a portion of the first image light LR. Each of the pixels 111*a* includes an opening 113 that emits the first pixel light LR1. Hereinafter, the ratio of the opening 113 to the entire pixel 111*a* is referred to as a pixel aperture ratio of the pixel 111*a*. The first light-emitting element 15 has an area corresponding to the pixel aperture ratio.

Further, in the second display region 211 of the second panel 20, a plurality of pixels 211*a* having a rectangular shape are provided in a matrix. The pixels 211*a* have the same size, and each is disposed at a predetermined pixel pitch P2. Here, in a case in which the color filter 77 (refer to FIG. 2) is formed in a divided manner for each of the pixels 211*a*, for example, the pixel pitch P2 is defined by a distance between a center of the color filter 77 provided to one pixel of two adjacent pixels 211*a* and a center of the color filter 77 provided to the other pixel.

Alternatively, in a case in which the color filter 77 is commonly provided to the plurality of pixels 211*a* and not formed in a divided manner, the pixel pitch P2 is defined by a distance between a center of the optical resonator 80 (refer to FIG. 2) provided to one pixel of two adjacent pixels 211*a* and a center of the optical resonator 80 provided to the other pixel.

Each of the pixels 211*a* emits second pixel light LG1 that constitutes a portion of the second image light LG. Each of the pixels 211*a* includes an opening 213 that emits the second pixel light LG1. Hereinafter, the ratio of the opening 213 to the entire pixel 211*a* is referred to as a pixel aperture ratio of the pixel 211*a*. The second light-emitting element 25 has an area corresponding to the pixel aperture ratio.

Further, in the third display region 311 of the third panel 30, a plurality of pixels 311*a* having a rectangular shape are provided in a matrix. The pixels 311*a* have the same size, and each is disposed at a predetermined pixel pitch P3. Here, in a case in which the color filter 77 (refer to FIG. 2) is formed in a divided manner for each of the pixels 311*a*, for example, the pixel pitch P3 is defined by a distance between a center of the color filter 77 provided to one pixel of two adjacent pixels 311*a* and a center of the color filter 77 provided to the other pixel.

Alternatively, in a case in which the color filter 77 is commonly provided to the plurality of pixels 311*a* and not formed in a divided manner, the pixel pitch P3 is defined by a distance between a center of the optical resonator 80 (refer to FIG. 2) provided to one pixel of two adjacent pixels 311*a* and a center of the optical resonator 80 provided to the other pixel.

Each of the pixels 311*a* emits third pixel light LB1 that constitutes a portion of the third image light LB. Each of the pixels 311*a* includes an opening 313 that emits the third pixel light LB1. Hereinafter, the ratio of the opening 313 to the entire pixel 311*a* is referred to as a pixel aperture ratio of the pixel 311*a*. The third light-emitting element 35 has an area corresponding to the pixel aperture ratio.

In this exemplary embodiment, the pixel pitches P1, P2, P3 of the first panel 10, the second panel 20, and the third panel 30 are the same. In other words, the number of pixels in the first display area 111, the second display area 211, and the third display area 311 are equal. Further, pixel sizes S1, S2, S3 of the first display region 111, the second display region 211, and the third display area 311 are equal.

Incidentally, a lifetime of the organic EL element generally depends on the light-emitting material and the element configuration. Therefore, a difference occurs in the lifetimes of the first light-emitting element 15, the second light-emitting element 25, and the third light-emitting element 35 that emit different colors.

Here, as a comparative example, consider an image light generation module in a case in which the pixel aperture ratios of the first panel 10, the second panel 20, and the third panel 30 are made equal.

The inventors identified the characteristics of an image light generation module in which the pixel aperture ratios of each panel are made equal by simulation, and summarized the results in a table. FIG. 4 is a table showing the characteristics related to the image light generation module of the comparative example. FIG. 4 shows the aperture ratio, lifetime, white point coordinates, and color shift due to deterioration (Δu'v') of each of the panels 10, 20, 30. Note that the lifetime corresponds to the lifetime of the LT50 standard, and refers to the time (h) until a brightness of the image light emitted from the panel is 50% or less.

As shown in the table in FIG. 4, in an image light generation module in which the pixel aperture ratios of each of the panels 10, 20, 30 are equally set to 60%, for example, it was confirmed that the lifetime of the first panel 10 that emits the first image light LR in the red wavelength region is the longest at 8000 h, the lifetime of the third panel 30 that emits the third image light LB in the blue wavelength region was the shortest at 5000 h, and the lifetime of the second panel 20 that emits the second image light LG in the green wavelength region was 6500 h. When the pixel aperture ratios of each of the panels 10, 20, 30 are thus equalized, a difference occurs in the lifetimes of the panels 10, 20, 30.

Specifically, in the image light generation module of the comparative example, deterioration of the third panel 30 progresses quickly over time compared to that of the first panel 10 and that of the second panel 20. Therefore, in the combined image light LL emitted from the image light generation module of the comparative example, the amount of light of the third image light LB in the blue wavelength region emitted from the third panel 30 decreases over time. Thus, due to the increasing lack of blue component in the combined image light LL over time, a color shift in which the hue shifts from yellow to red occurs. That is, the combined image light LL emitted from the image light generation module of the comparative example has a color shift of the white point of the LT50 standard of "0.0335", as shown in FIG. 4.

In contrast, in the image light generation module 1 of this exemplary embodiment, it is possible to reduce the lifetime difference described above by making the pixel aperture ratios of the first panel 10, the second panel 20, and the third panel 30 different from each other, and varying the areas of the first light-emitting element 15, the second light-emitting element 25, and the third light-emitting element 35.

Hereinafter, the action obtained by the image light generation module 1 of this exemplary embodiment will be described. The inventors identified, by simulation, the characteristics of the image light generation module 1 of this exemplary embodiment in which the pixel aperture ratios of each panel are each made different, and summarized the results in a table. FIG. 5 is a table showing the characteristics related to the image light generation module 1 of this exemplary embodiment. FIG. 5, similar to the table in FIG. 4, shows the aperture ratio, lifetime, white point coordinates, and color shift due to deterioration (Δu'v') of each of the panels 10, 20, 30.

Here, consider a case in which a current supplied to the light-emitting element constituting the pixel is constant and the pixel aperture ratio is reduced. When the pixel aperture ratio is reduced while a constant current is supplied to the light-emitting element, the current per unit area supplied to the light-emitting element, hereinafter current density, is increased. When the current density of the light-emitting element increases, the deterioration rate of the light-emitting element increases, thereby shortening the lifetime of the light-emitting element. In other words, the lifetime of the light-emitting element can be controlled by adjusting the pixel aperture ratio.

In the image light generation module 1 of this exemplary embodiment, as illustrated in the comparative example described above, the lifetimes of the first panel 10 and the second panel 20 having relatively long lifetimes are aligned to that of the third panel 30 having the shortest lifetime by making the pixel aperture ratios of the first panel 10 and the second panel 20 smaller that the pixel aperture ratio of the third panel 30.

Specifically, in the image light generation module 1 of this exemplary embodiment, as shown in the table in FIG. 5, the pixel aperture ratio of the first panel 10 having the longest lifetime in the comparative example was set to 45.5%, which is the smallest value, the pixel aperture ratio of the third panel 30 having the shortest lifetime in the comparative example was set to 60.0%, which is the largest value, and the pixel aperture ratio of the second panel 20 having an intermediate lifetime was set to 51.4%, which is a value greater than that of the first panel 10 and smaller than that of the third panel 30.

Here, the pixel aperture ratio of each of the panels 10, 20, 30 is calculated by the formula below. Note that, in the formula below, lifetime [shortest color] corresponds to the color, from among the three colors, having the shortest lifetime, that is, the lifetime of the light-emitting element that emits blue light. Further, [target color] corresponds to the two colors other than the shortest lifetime color described above, and in this exemplary embodiment corresponds to green and red. Further, maximum aperture ratio corresponds to the largest aperture ratio that can be adopted in terms of panel design and, in this exemplary embodiment, for example, corresponds to 60%. Furthermore, "acceleration coefficient" is a coefficient defined from the current density supplied to the light-emitting element that emits light of the target color, is generally set to about 1.4 to 1.9, and was set to 1.7 in this exemplary embodiment.

Aperture ratio [target color]=(Lifetime [shortest color]/Lifetime [target color])^(1/Acceleration coefficient [target color])*Maximum aperture ratio The image light generation module 1 of this exemplary embodiment sets the pixel aperture ratio of the first panel 10 to the smallest value (45.5%), thereby largely increasing the current density of the first light-emitting element 15 that constitutes each of the pixels 111*a*, increasing the deterioration rate of the first panel 10, and making the lifetime significantly shorter than the 8000 h of the comparative example. Specifically, the lifetime of the first panel 10 that emits the first image light LR in the red wavelength region is 4998 h, and is substantially equal to the lifetime of the third panel 30 (5000 h).

Further, the image light generation module 1 of this exemplary embodiment sets the pixel aperture ratio of the second panel 20 to an intermediate value (51.4%), thereby slightly increasing the current density of the second light-emitting element 25 that constitutes each of the pixels 211*a*, increasing the deterioration rate of the second panel 20, and making the lifetime significantly shorter than the 6500 h of the comparative example. Specifically, the lifetime of the second panel 20 that emits the second image light LG in the green wavelength region is 4995 h, and is substantially equal to the lifetime of the third panel 30 (5000 h).

As described above, according to the image light generation module 1 of this exemplary embodiment, by making the pixel aperture ratios of each panel 10, 20, 30 different from each other, it is possible to reduce the lifetime difference between the panels 10, 20, 30. When the lifetime difference between the panels 10, 20, 30 is thus reduced, the panels 10, 20, 30 deteriorate at substantially the same rate over time. Therefore, the amounts of the first image light LR, the second image light LG, and the third image light LB included in the combined image light LL emitted from the image light generation module 1 of this exemplary embodiment decrease at substantially the same rate over time. Thus, the amount of light of the combined image light LL decreases in a state in which the change in hue over time is reduced.

Thus, according to the image light generation module 1 of this exemplary embodiment, it is possible to emit the combined image light LL having a color shift of the white point of the LT50 standard suppressed to less than 0.001, as shown in FIG. 5.

Further, in the image light generation module 1 according to this exemplary embodiment, the combined image light LL emitted from the emitting surface 54 is formed of a plurality of pixel light beams LL1. Each of the pixel light beams LL1 is light obtained by combining the first pixel light LR1 emitted from one pixel 111*a* in the first display region 111, the second pixel light LG1 emitted from one pixel 211*a* in the second display region 211, and the third pixel light LB1 emitted from one pixel 311*a* in the third display region 311.

Hereinafter, one of the plurality of pixels 111*a* of the first panel 10 illustrated in FIG. 3 is referred to as a first pixel 114. Further, one of the plurality of pixels 211*a* of the second panel 20 illustrated in FIG. 3 is referred to as a second pixel 214. Further, one of the plurality of pixels 311*a* of the third panel 30 illustrated in FIG. 3 is referred to as a third pixel 314.

The first pixel 114 of the first panel 10, the second pixel 214 of the second panel 20, and the third pixel 314 of the third panel 30 correspond to each other. That is, the first pixel light LR1 emitted from the first pixel 114 is combined with the second pixel light LG1 emitted from the second pixel 214 and the third pixel light LB1 emitted from the third pixel 314, thereby producing the pixel light beam LL1 that forms one pixel of the combined image light LL.

Note that the other pixels 111*a*, 211*a*, 311*a* in the respective panels 10, 20, 30 have similar corresponding relationships. Therefore, the pixel light emitted from each of the pixels 111*a*, 211*a*, 311*a* of the respective panels 10, 20, 30 is combined, thereby producing the pixel light beam LL1.

As described above, in the image light generation module 1 of this exemplary embodiment, the pixel light beams LL1 emitted from the corresponding pixels 111*a*, 211*a*, 311*a* of the respective panels 10, 20, 30 are combined, thereby producing the combined image light LL formed of the plurality of pixel light beams LL1.

FIG. 6 is a drawing illustrating the emitting surface 54 of the dichroic prism 50 in plan view. FIG. 6 illustrates the light emitted from, among the plurality of pixels 111*a*, 211*a*, 311*a* in the respective panels 10, 20, 30, only the light emitted from the first pixel 114, the second pixel 214, and the third pixel 314. The first pixel 114, the second pixel 214, and the third pixel 314 are positioned, for example, in a central portion of the plurality of pixels of the respective panels 10, 20, 30. Note that the same applies to the pixel light emitted from the pixels 111*a*, 211*a*, 311*a* other than the first pixel 114, the second pixel 214, and the third pixel 314.

As illustrated in FIG. 6, in the plan view of the emitting surface 54, a first central axis C1 of the first pixel light LR1 emitted from the first pixel 114, a second central axis C2 of the second pixel light LG1 emitted from the second pixel 214, and a third central axis C3 of the third pixel light LB1 emitted from the third pixel 314 coincide with each other. A cross-sectional shape of the first pixel light LR1, the second pixel light LG1, and the third pixel light LB1 along the emitting surface 54 is rectangular.

Here, the first central axis C1 of the first pixel light LR1 is an axis passing through a center of the first pixel 114, that is, the center of the color filter 77 (refer to FIG. 2) of the first pixel 114. The second central axis C2 of the second pixel light LG1 is an axis passing through a center of the second pixel 214, that is, the center of the color filter 77 (refer to FIG. 2) of the second pixel 214. The third central axis C3 of the third pixel light LB1 is an axis passing through a center of the third pixel 314, that is, the center of the color filter 77 (refer to FIG. 2) of the third pixel 314.

In other words, in the image light generation module 1 of this exemplary embodiment, the first pixel light LR1, the second pixel light LG1, and the third pixel light LB1 overlap in a state in which the respective central axes C1, C2, C3 coincide, thereby producing one pixel light beam LL1 of the combined image light LL. By making the central axes C1, C2, C3 coincide in this way, a large tolerance can be set for a position shift when the first pixel light LR1, the second pixel light LG1, and the third pixel light LB1 are overlapped. Thus, the pixel light beam LL1 is produced by favorably overlapping the first pixel light LR1, the second pixel light LG1, and the third pixel light LB1.

Note that, as described above, the first pixel 114, the second pixel 214, and the third pixel 314 are center pixels of the respective panels 10, 20, 30. In this case, the image light generation module 1 of this exemplary embodiment can at least favorably overlap pixels positioned at a center of the image light easily visible to an eye of an observer. Therefore, even if the pixels overlap on a peripheral side of the image light, the image visually recognized by the observer is not likely to be affected.

As described above, the combined image light LL emitted from the image light generation module 1 of this exemplary embodiment is formed of the plurality of pixel light beams LL1 obtained by precisely overlapping the pixel light of each color, and thus a color shift of the white point of the LT50 standard can be suppressed to within 0.001. According to this combined image light LL, even when an image is displayed magnified in applications such as augmented reality (AR) and virtual reality (VR), for example, a high-quality image not susceptible to color unevenness can be provided.

In FIG. 6, an example is given of a case in which the first pixel light LR1, the second pixel light LG1, and the third pixel light LB1 are overlapped with the central axes C1, C2, C3 made to coincide, but the way of overlapping the first pixel light LR1, the second pixel light LG1, and the third pixel light LB1 is not thereto. Below, a description will be given of different ways of overlapping the image light with reference to the drawings.

FIG. 7A to FIG. 7D are diagrams illustrating modified examples of ways of overlapping the pixel light of three colors.

Figure 7B:
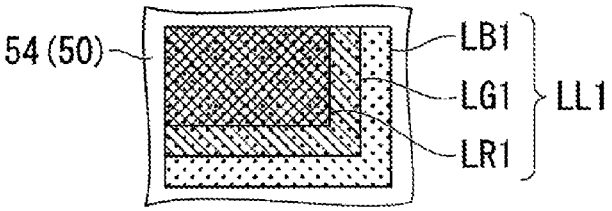
FIG. 7B is a diagram illustrating a modified example of a way of overlapping the pixel light.
Figure 7C:
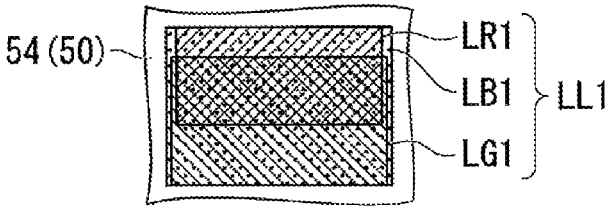
FIG. 7C is a diagram illustrating a modified example of a way of overlapping the pixel light.

As illustrated in FIG. 7A, the pixel light LL1 may be produced by overlapping each of the first pixel light LR1, the second pixel light LG1, and the third pixel light LB1 with one side aligned. As illustrated in FIG. 7B, the pixel light LL1 may be produced by overlapping each of the first pixel light LR1, the second pixel light LG1, and the third pixel light LB1 with one corner aligned. As illustrated in FIG. 7C, the pixel light LL1 may be produced by overlapping each of the first pixel light LR1 and the third pixel light LB1 with one side aligned, and overlapping the second pixel light LG1 and the third pixel light LB1 with one side, different from that of the second pixel light LG1 and the third pixel light LB1, aligned. In other words, in the mode illustrated in FIG. 7C, unlike the other modes, luminous flux shapes of the first pixel light LR1, the second pixel light LG1, and the third pixel light LB1 do not have a relationship of similarity.

By overlapping the first pixel light LR1, the second pixel light LG1, and the third pixel light LB1 as illustrated in FIGS. 7A to 7C, it is possible to suppress the color shift of the white point of the LT50 standard to within 0.02.

Figure 7D:
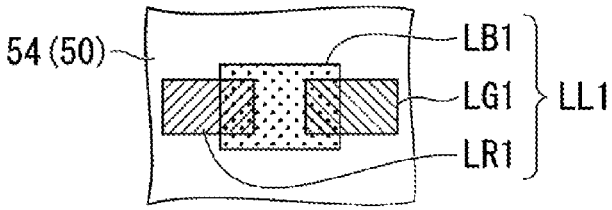
FIG. 7D is a diagram illustrating a modified example of a way of overlapping the pixel light.

Further, while the exemplary embodiment described above and the modes illustrated in FIGS. 7A to 7C illustrate examples in which the first pixel light LR1 and the second pixel light LG1 entirely overlap the third pixel light LB1, the first pixel light LR1 and the second pixel light LG1 may be made to partially overlap the third pixel light LB1 as illustrated in FIG. 7D.

Second Exemplary Embodiment

A second exemplary embodiment according to the present disclosure will be described below with reference to the drawings.

The image light generation module 1 described in the first exemplary embodiment described above is used in an image display device described below.

Figure 8:
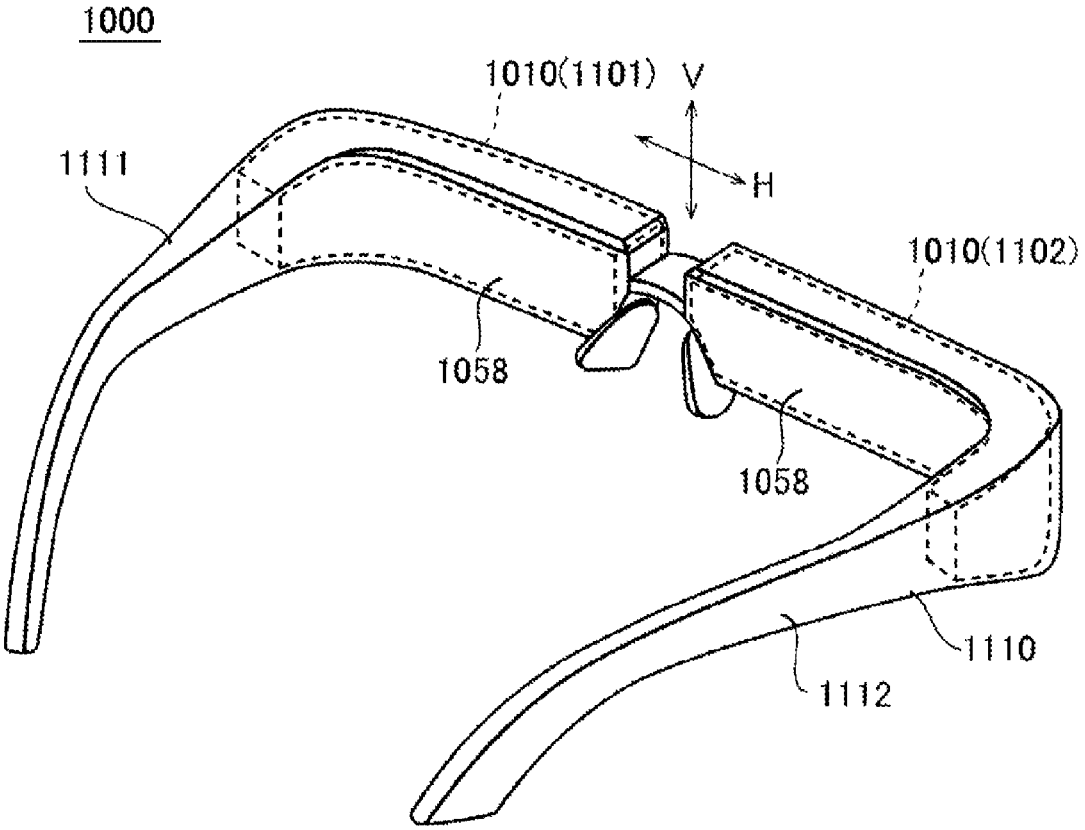
FIG. 8 is an explanatory view of a head-mounted display device according to a second exemplary embodiment.
Figure 9:
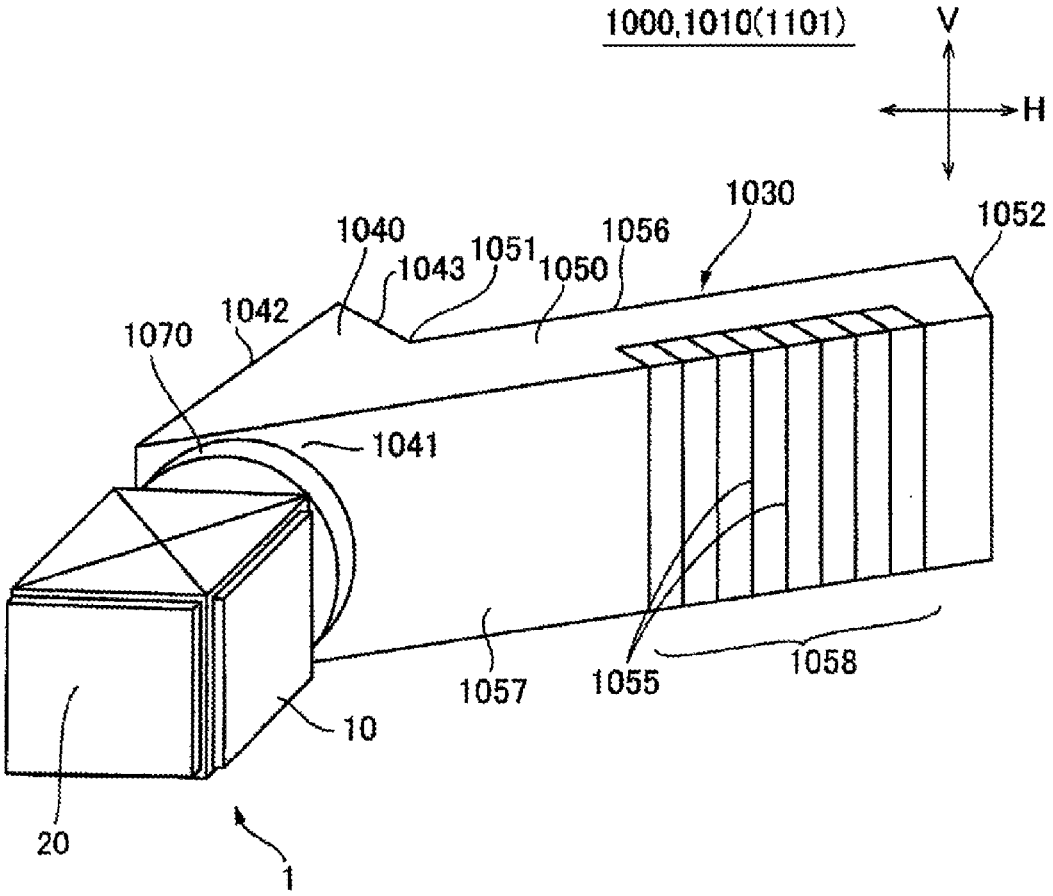
FIG. 9 is a perspective view schematically illustrating a configuration of an optical system of virtual image display units.
Figure 10:
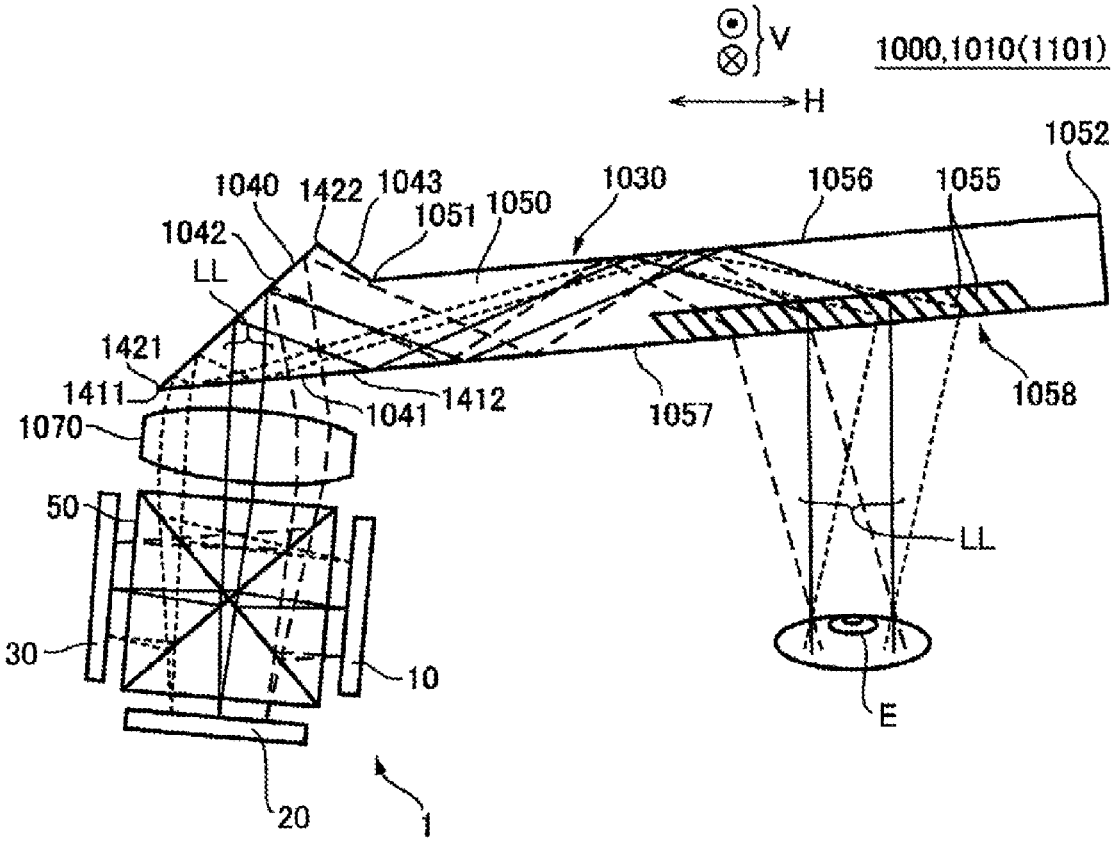
FIG. 10 is an explanatory diagram illustrating optical paths of the optical system.

FIG. 8 is an explanatory view of a head-mounted display device 1000 according to the second exemplary embodiment. FIG. 9 is a perspective view schematically illustrating a configuration of an optical system of virtual image display units 1010 illustrated in FIG. 8. FIG. 10 is an explanatory view illustrating optical paths of the optical system illustrated in FIG. 9.

As illustrated in FIG. 8, the head-mounted display device 1000 (image display device) is configured as a see-through type eyeglass display, and includes a frame 1110 provided with left and right temples 1111, 1112. In the head-mounted display device 1000, the virtual image display units 1010 are supported by the frame 1110, and an image emitted from the virtual image display units 1010 is caused to be recognized as a virtual image by a user. In this exemplary embodiment, the head-mounted display device 1000 is provided with a left-eye display unit 1101 and a right-eye display unit 1102 as the virtual display units 1010. The left-eye display unit 1101 and the right-eye display unit 1102 have the same configuration, and are disposed left-right symmetrically.

In the following description, the left-eye display unit 1101 will be mainly described, and the description of the right-eye display unit 1102 will be omitted.

As illustrated in FIG. 9 and FIG. 10, in the head-mounted display device 1000, the left-eye display unit 1101 includes the image light generation module 1, and a light guiding system 1030 that guides the combined image light LL emitted from the image light generation module 1 to an emitting portion 1058. A projection lens system 1070 is disposed between the image light generation module 1 and the light guiding system 1030, and the combined image light LL emitted from the image light generation module 1 is incident on the light guiding system 1030 via the projection lens system 1070. The projection lens system 1070 is configured by a single collimate lens that has a positive power.

The image light generation module 1 includes the dichroic prism 50, and the three panels 10, 20, 30 provided facing three of four surfaces (the third surface of the right-angled triangular prism) of the dichroic prism 50. The panels 10, 20, 30 are each composed of, for example, an organic EL panel.

The image light emitted from the first panel 10 is incident on the dichroic prism 50 as the first image light LR in a first wavelength region. The image light emitted from the second panel 20 is incident on the dichroic prism 50 as the second image light LG in a second wavelength region. The image light emitted from the third panel 30 is incident on the dichroic prism 50 as the third image light LB in a third wavelength region. The combined image light LL obtained by combining the first image light LR, the second image light LG, and the third image light LB is emitted from the dichroic prism 50.

The light guiding system 1030 includes an incidence portion 1040 having transmissivity and from which the combined light LL enters, and a light guiding portion 1050 having transmissivity and including one end 1051 side coupled to the incidence portion 1040. In this exemplary embodiment, the incidence portion 1040 and the light guiding portion 1050 are configured as an integrated light transmissive member.

The incidence portion 1040 includes an incident surface 1041 from which the combined light LL emitted from the image light generation module 1 enters, and a reflection surface 1042 that reflects the combined light LL that has entered from the incident surface 1041, the combined light LL being reflected between the reflection surface 1042 and the incident surface 1041. The incident surface 1041 is a flat surface, an aspherical surface, a free form surface, or the like, and faces the image light generation module 1 with the projection lens system 1070 interposed therebetween. The projection lens system 1070 is disposed obliquely such that an interval between the projection lens system 1070 and an end portion 1412 of the incident surface 1041 is larger than an interval between the projection lens system 1070 and an end portion 1411 of the incident surface 1041.

Although no reflection film is formed on the incident surface 1041, the incident surface 1041 fully reflects light that enters at an incident angle equal to or greater than a critical angle. Thus, the incident surface 1041 has a light transmissive property and a light reflecting property. The reflection surface 1042 is a surface that faces the incident surface 1041, and is disposed obliquely such that an end portion 1422 is located further away from the incident surface 1041 than an end portion 1421 of the incident surface 1041. Thus, the incidence portion 1040 has a substantially triangular shape. The reflection surface 1042 is a flat surface, an aspherical surface, a free form surface, or the like. The reflection surface 1042 has a configuration in which a reflective metal layer made mainly of aluminum, silver, magnesium, chromium, or the like, is formed.

The light guiding portion 1050 includes a first surface 1056 (first reflection surface) that extends from one end 1051 toward the other end 1052 side, a second surface 1057 (second reflection surface) that faces the first surface 1056 in a parallel manner and extends from the one end 1051 side toward the other end 1052 side, and an emitting portion 1058 provided on a portion of the second surface 1057 that is apart from the incidence portion 1040. The first surface 1056 and the reflection surface 1042 of the incidence portion 1040 are joined together via a sloped surface 1043. A thickness of the first surface 1056 and the second surface 1057 is thinner than that of the incident portion 1040. The first surface 1056 and the second surface 1057 reflect all the light that is incident at an incident angle greater than or equal to the critical angle, based on a refractive index difference between the light guiding portion 1050 and the outside (the air). Thus, no reflection film is formed on the first surface 1056 and the second surface 1057.

The emitting portion 1058 is configured on a portion of the light guiding portion 1050 on the second surface 1057 side in the thickness direction. In the emitting portion 1058, a plurality of partial reflection surfaces 1055 angled obliquely with respect to a normal line to the second surface 1057 are arranged to be parallel to each other. The emitting portion 1058 is a portion of the second surface 1057 that overlaps the plurality of partial reflection surfaces 1055, and is a region that has a predetermined width in an extending direction of the light guiding portion 1050. Each of the plurality of partial reflection surfaces 1055 is composed of a dielectric multilayer film. In addition, at least one of the plurality of partial reflection surfaces 1055 may be a composite layer including a dielectric multilayer film and a reflective metal layer (thin film) made mainly of aluminum, silver, magnesium, chromium, or the like. When the partial reflection surface 1055 is configured to include a metal layer, it is possible to obtain an effect of enhancing the reflectance of the partial reflection surface 1055, or to obtain an effect of optimizing the incident angle dependence or the polarization dependence of the transmittance and the reflectance of the partial reflection surface 1055. Note that the emitting portion 1058 may have a mode in which an optical element such as a diffraction grating and a hologram is provided.

In the head-mounted display device 1000 having the configuration described above, the combined image light LL formed of the parallel light that enters from the incidence portion 1040 is refracted on the incident surface 1041 and travels toward the reflection surface 1042. Next, the combined image light LL is reflected on the reflection surface 1042, and travels toward the incident surface 1041 again. At this time, since the combined image light LL enters the incident surface 1041 at the incident angle greater than or equal to the critical angle, the combined image light LL is reflected on the incident surface 1041 toward the light guiding portion 1050, and travels toward the light guiding portion 1050. Note that the incidence portion 1040 is configured such that the combined image light LL that is the parallel light enters the incident surface 1041. However, it may be possible to adopt a configuration in which the incident surface 1041 and the reflection surface 1042 are configured to have a free form curve or the like, and after the combined image light LL, which is non-parallel light, enters the incident surface 1041, the combined image light LL is reflected between the reflection surface 1042 and the incident surface 1041 to be converted into the parallel light while being reflected.

In the light guiding portion 1050, the combined image light LL is reflected between the first surface 1056 and the second surface 1057, and advances. Then, part of the combined image light LL that enters the partial reflection surface 1055 is reflected on the partial reflection surface 1055 and is emitted from the emitting portion 1058 toward an eye E of an observer. Further, the rest of the combined image light LL incident on the partial reflection surface 1055 passes through the partial reflection surface 1055 and is incident on the next adjacent, partial reflection surface 1055. Thus, the combined image light LL reflected on each of the plurality of partial reflection surfaces 1055 is emitted from the emitting portion 1058 toward the eye E of the observer. This enables the observer to recognize a virtual image.

At this time, as for the light entering the light guiding portion 1050 from the outside, this light passes through the partial reflection surfaces 1055 after entering the light guiding portion 1050, and reaches the eye E of the observer. This enables the observer to see the color image emitted from the image light generation module 1 and also see the scenery of the outside world and the like in a see-through manner.

The head-mounted display device 1000 according to the second exemplary embodiment includes the image light generation module 1 of the first exemplary embodiment, making it possible to display a high-quality image with reduced occurrences of color unevenness.

Note that in the head-mounted display device 1000 of the second exemplary embodiment, an example is given of a case in which the light guiding portion 1050 is used as the light guiding system 1030. However, the head-mounted display device may be configured by applying the image light generation module 1 of the first exemplary embodiment to an optical system that does not use the light guiding portion.

Third Exemplary Embodiment

Below, a third exemplary embodiment according to the present disclosure will be described with reference to FIG. 11.

The image light generation module 1 described in the above-described first exemplary embodiment is used in a display device described below.

Figure 11:
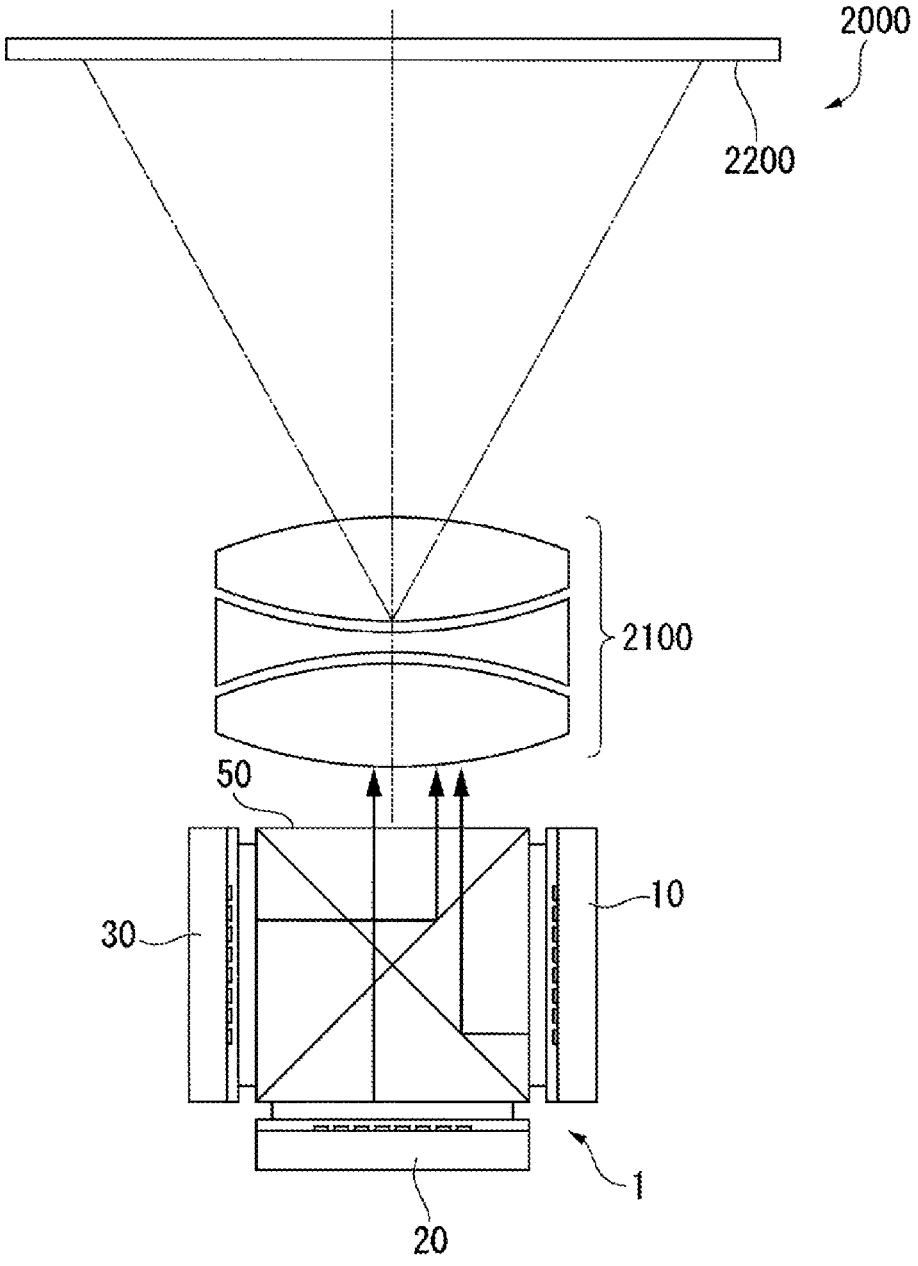
FIG. 11 is a schematic configuration view of a projection-type display device according to a third exemplary embodiment.

FIG. 11 is a schematic configuration view illustrating a projection-type display device 2000 according to the third exemplary embodiment.

As illustrated in FIG. 11, the projection-type display device 2000 (image display device) includes the image light generation module 1 according to the above-described exemplary embodiments, and a projection optical system 2100 that expands the combined image light LL emitted from the image light generation module 1 and projects it onto a projection receiving member 2200 such as a screen.

The image light generation module 1 includes the dichroic prism 50, and the three panels 10, 20, 30 provided facing three of four surfaces (the third surface of the right-angled triangular prism) of the dichroic prism 50. The panels 10, 20 30 are each composed of, for example, an organic EL panel or other panel that emits image light not having polarization characteristics.

The projection-type display apparatus 2000 according to the third exemplary embodiment includes the image light generation module 1 of the first exemplary embodiment, making it possible to display a high-quality image with reduced occurrences of color unevenness.

Note that the technical scope of the present disclosure is not limited to the above-described exemplary embodiments, and various modifications can be made to the above-described exemplary embodiments without departing from the spirit and gist of the present disclosure.

For example, it may be possible to change, as appropriate, the material, number, arrangement, shape, or other specific configurations of each constituent element of the image light generation module and the image display device given as examples in the exemplary embodiments described above.

Further, in the exemplary embodiments described above, the lifetime of the light-emitting material that emits light in the blue wavelength region is described as the shortest. However, the configuration of the present disclosure can also be applied with the color having the shortest lifetime being a color other than blue, in accordance with the light-emitting material, the configuration, and the like.

Further, in the exemplary embodiments described above, an organic EL panel not having polarization characteristics is given as an example of the first panel, the second panel, and the third panel constituting the image light generation module. However, the image display panel is not limited to the organic EL panel, and an inorganic EL panel, micro light-emitting diode (LED) panel, or other self-light-emission panel not having polarization characteristics may be used. Further, an organic EL panel imparted with polarizing characteristics may be used as the first panel, the second panel, and the third panel.

Further, as the organic EL panel, a configuration may be adopted in which the pixel light is collected and diverged by the color filter 77 by shifting the position of the color filter 77 (refer to FIG. 2) relative to the optical resonator 80 (refer to FIG. 2) in accordance with the position of the pixels in the panel. In this case, the pixel pitch changes from location to location in the first panel, the second panel, and the third panel, but the manner in which the pixel pitch changes is common to the first panel, the second panel, and the third panel.

Further, a configuration in which the aperture ratio of the present disclosure is different for each pixel, and a configuration in which the image light from each pixel is partially overlapped or the central axes of the image light are overlapped may be applied to an image light generation module in which two panels and a dichroic prism are combined. In this case, one of the two panels emits pixel light of two colors, and the other of the two panels emits pixel light of the remaining one color. The overlapping of the pixel light of two colors emitted from the one panel and the pixel light of one color emitted from the other panel is as illustrated in FIG. 7D.

Further, an example of the image display device including the image light generation module described in the above-described exemplary embodiments includes an electronic view finder (EVF) or the like used in an imaging device such as a video camera and a still camera.

What is claimed is:

1. An image light generation module comprising:

a first panel configured to emit first image light including a red wavelength region, the first image light not having polarization characteristics;

a second panel configured to emit second image light including a green wavelength region, the second image light not having polarization characteristics;

a third panel configured to emit third image light including a blue wavelength region, the third image light not having polarization characteristics; and a color combining prism configured to emit combined light obtained by combining the first image light, the second image light, and the third image light, wherein the first panel includes a plurality of pixels that has a first aperture, the second panel includes a plurality of pixels that has a second aperture, the third panel includes a plurality of pixels that has a third aperture, an area of the first aperture of all the pixels provided on the first panel is the same, an area of the second aperture of all the pixels provided on the second panel is the same, an area of the third aperture of all the pixels provided on the third panel is the same, the area of the first aperture, the area of the second aperture, and the area of the third aperture are different from each other.

2. The image light generation module according to claim 1, wherein the color combining prism includes an emitting surface configured to emit the combined light and in plan view of the emitting surface, at least a portion of each of first pixel light emitted from a first pixel of the first panel, second pixel light emitted from a second pixel of the second panel, and third pixel light emitted from a third pixel of the third panel overlaps.

3. The image light generation module according to claim 1, wherein the color combining prism includes an emitting surface configured to emit the combined light and in plan view of the emitting surface, a first central axis of first pixel light emitted from a first pixel of the first panel with the first central axis passing through a center of the first pixel, a second central axis of second pixel light emitted from a second pixel of the second panel with the second central axis passing through a center of the second pixel, and a third central axis of third pixel light emitted from a third pixel of the third panel with the third central axis passing through a center of the third pixel coincide with each other.

4. The image light generation module according to claim 1, wherein the first panel, the second panel, and the third panel have the same pixel pitch.

5. The image light generation module according to claim 1, wherein the first panel, the second panel, and the third panel are organic EL panels.

6. An image display device comprising:

the image light generation module according to claim 1.

7. The image light generation module according to claim 1, further comprising:

a first adhesive provided so as to bond between the first panel and a first surface of the color combining prism;

a second adhesive provided so as to bond between the second panel and a second surface of the color combining prism; and a third adhesive provided so as to bond between the third panel and a third surface of the color combining prism.

* * * * *